US005299323A

United States Patent [19]

Schaefer et al.

[11] Patent Number: 5,299,323

[45] Date of Patent: * Apr. 5, 1994

[54] INTEGRAL ADJUSTMENT SYSTEM FOR GARMENTS

[76] Inventors: Aaron Schaefer, 1415 N. Brand Blvd. No H., Glendale, Calif. 91202; James Ranney, 2900 Jolley Dr., Burbank, Calif. 91504

[ * ] Notice: The portion of the term of this patent subsequent to May 11, 2010 has been disclaimed.

[21] Appl. No.: 13,303

[22] Filed: Feb. 4, 1993

Related U.S. Application Data

[63] Continuation-in-part of Ser. No. 831,355, Feb. 5, 1992, Pat. No. 5,208,920.

[51] Int. Cl.[5] ..... A41D 1/00; A41D 27/10

[52] U.S. Cl. ..... 2/93; 2/269; 2/227; 2/237; 2/236; 2/270; 2/272; 2/220; 2/221; 2/76; 2/243.1

[58] Field of Search ..... 2/269, 227, 237, 236, 2/243 R, 270, 272, DIG. 6, 76, 220, 221, 93

[56] References Cited

U.S. PATENT DOCUMENTS 560,683 5/1896 Bruckner ..... 2/227
2,687,530 8/1954 Farnum ..... 2/269
2,692,988 11/1954 Rouse ..... 2/269
2,719,981 10/1955 Walter ..... 2/269
4,985,936 1/1991 Jones ..... 2/269

*Primary Examiner*—Clifford D. Crowder
*Assistant Examiner*—Gloria Hale
*Attorney, Agent, or Firm*—Wagner & Middlebrook

[57] ABSTRACT

The present invention discloses an adjustment system for forming a repeatedly adjustable hem on a garment. There is provided an adjustment mechanism comprising of a cord with one end that is attached to the garment's inside hem while the other end passes through a holding pocket or channel that is secured to the garment's inside seam. The second end of the cord above the holding pocket or channel is then preferably knotted to provide a stop or limit to adjust and the second end is secured to the garment lining. The fabric lining conceals the adjustment mechanism. A fabric tab is secured to the second end and the lining as a grasping point for making a length adjustment. The bloused lining is smoothed, the garment is pressed, and the adjustment is complete and undetectable. Embodiments are shown for adjusting trouser leg lengths, coat or jacket sleeves or body length as well as skirt and waistband adjustment.

22 Claims, 8 Drawing Sheets

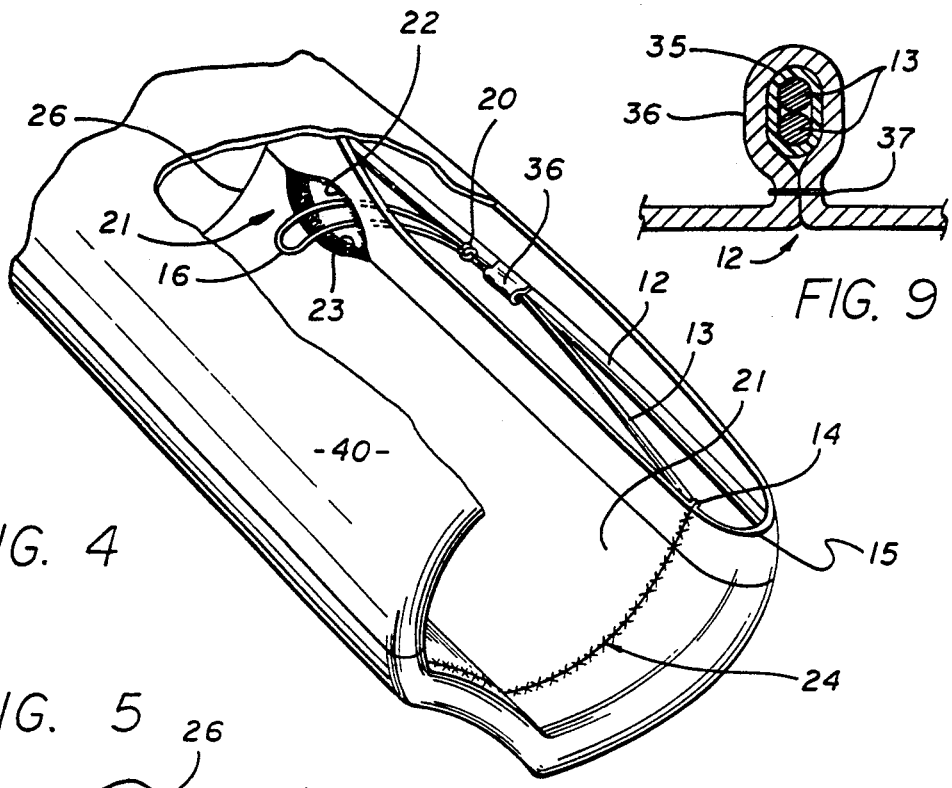
FIG. 4
FIG. 9
FIG. 5
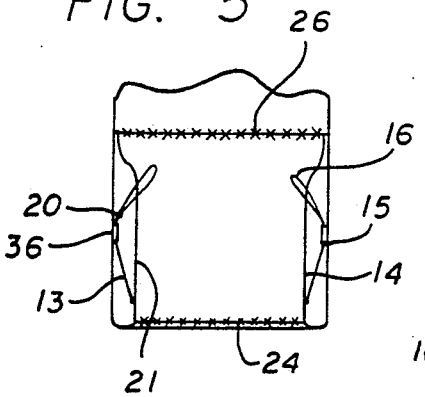
FIG. 7
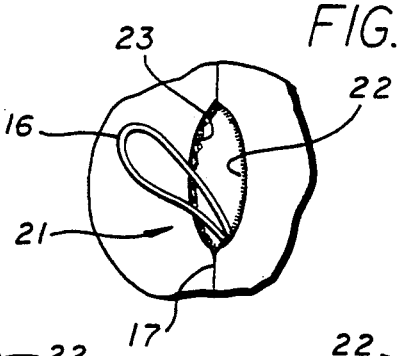
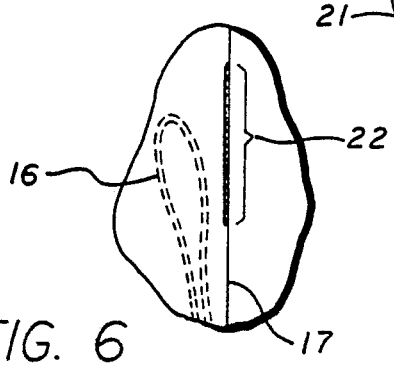
FIG. 6
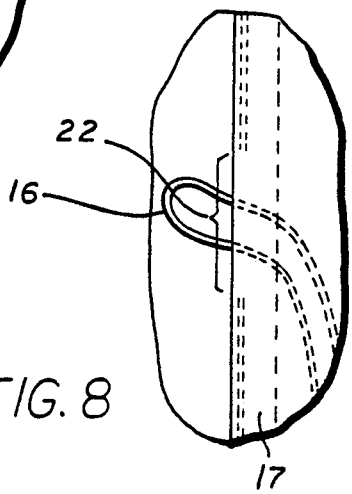
FIG. 8

FIG. 13
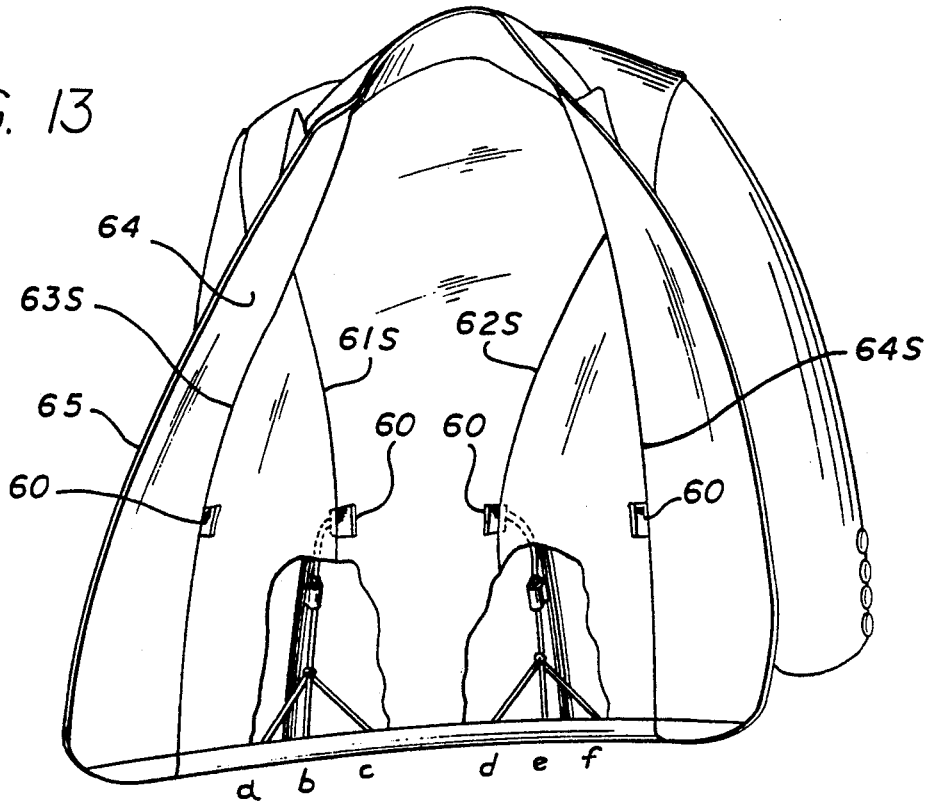
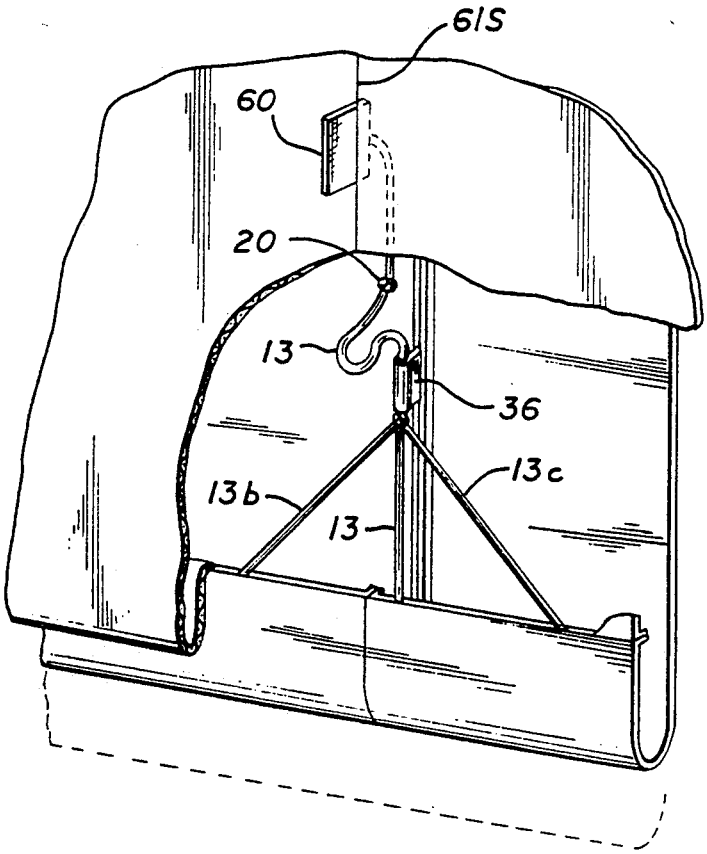
FIG. 14

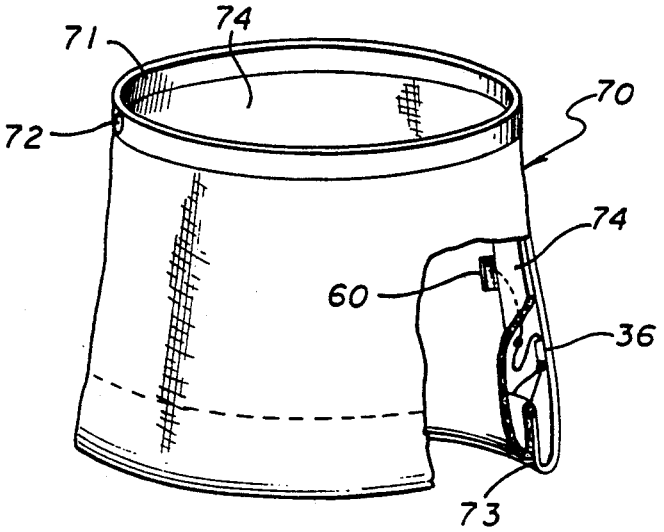
FIG. 15
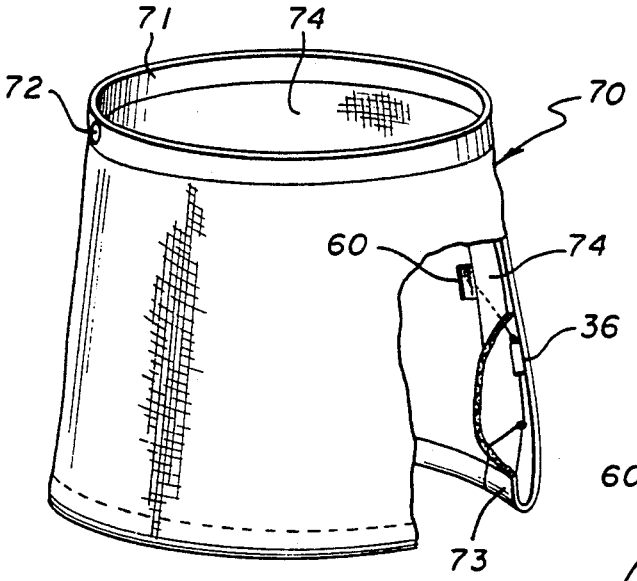
FIG. 16
FIG. 18
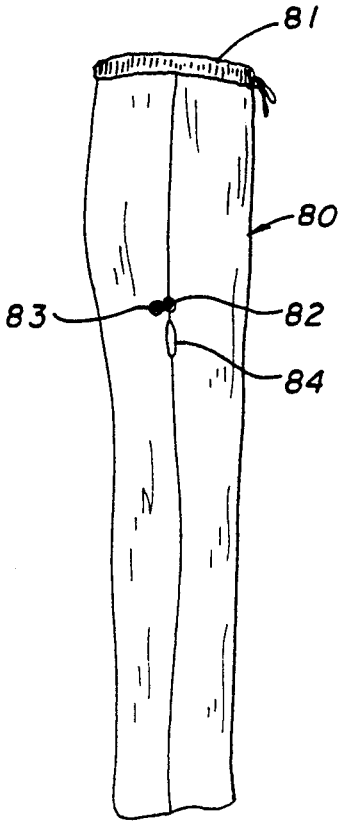
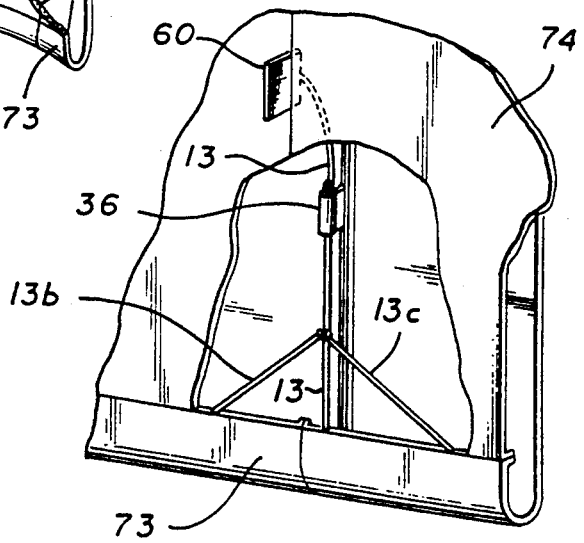
FIG. 17

FIG. 19
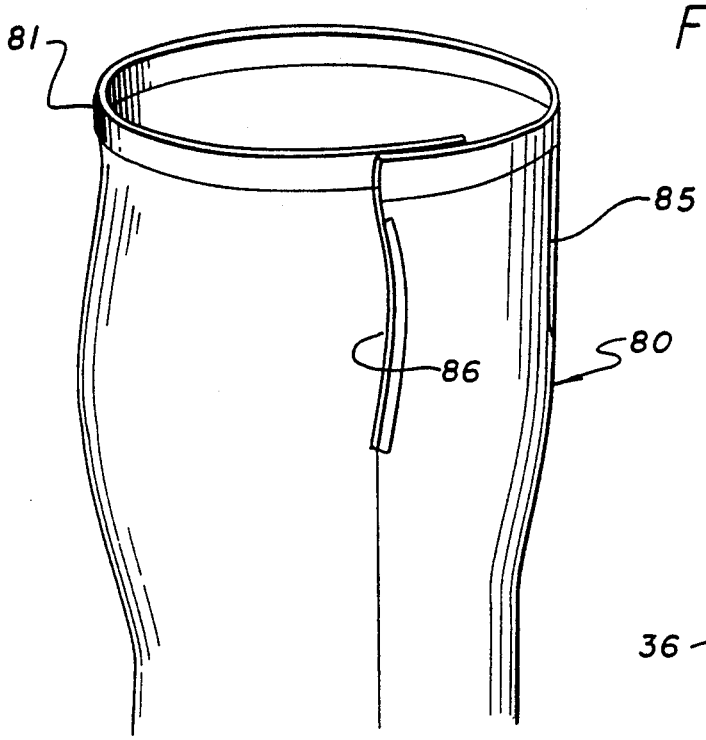
FIG. 21
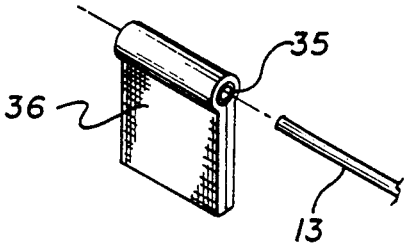
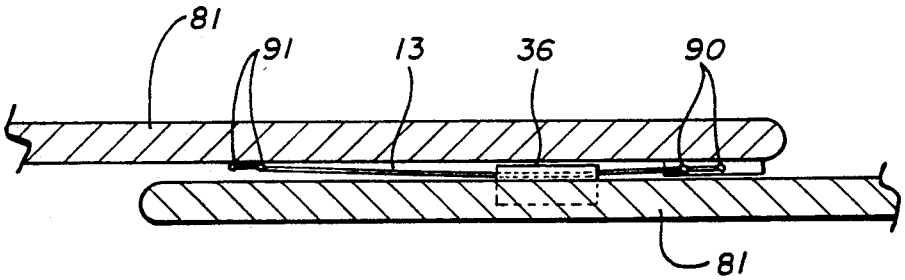
FIG. 20

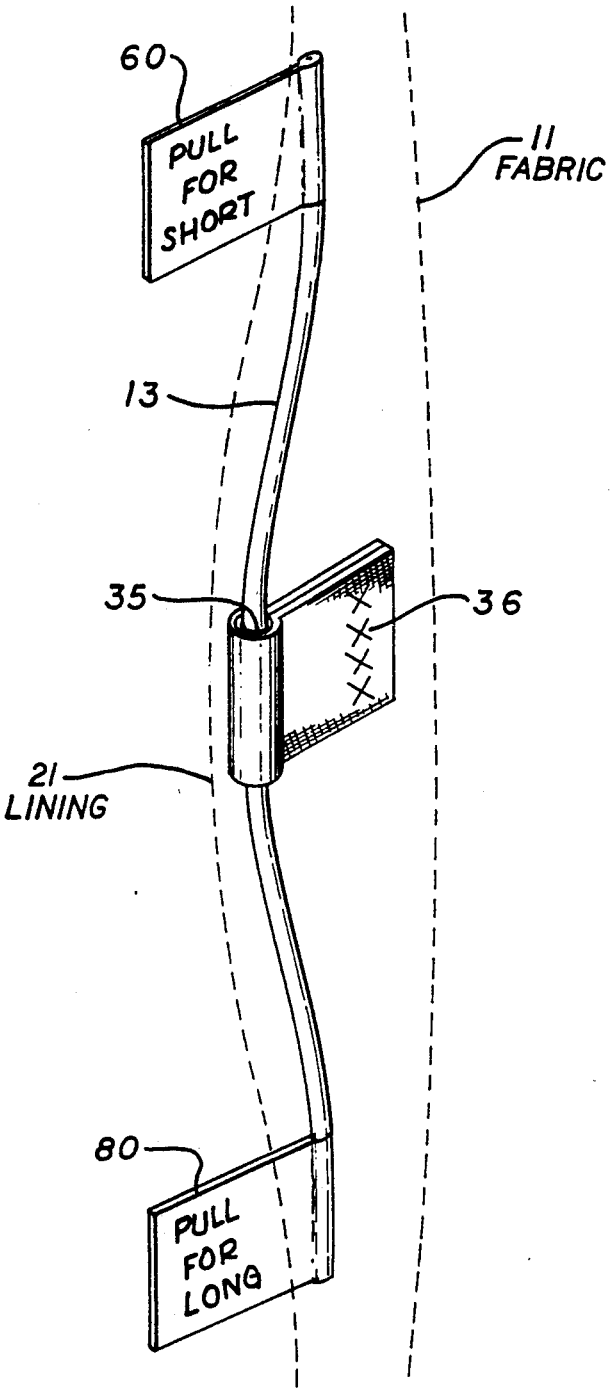
FIG. 22
FIG. 23
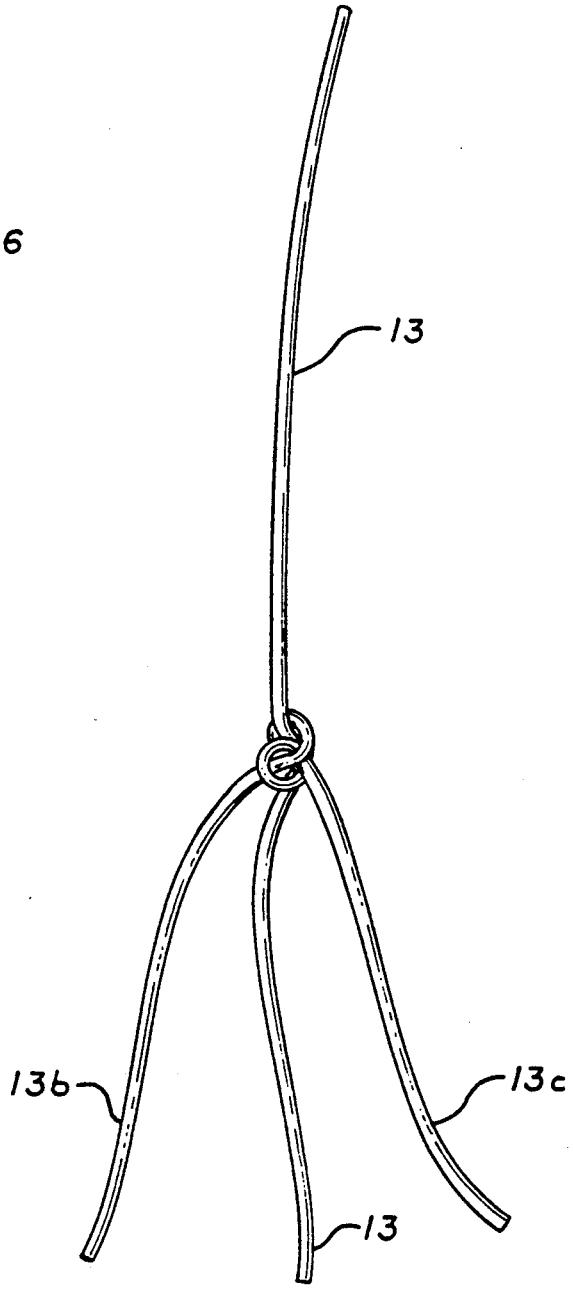

INTEGRAL ADJUSTMENT SYSTEM FOR GARMENTS

REFERENCE TO RELATED APPLICATION

This is a continuation in part of U.S. application Ser. No. 07/831,355 filed Feb. 5, 1992 of Aaron Schaefer and James Ranney now U.S. Pat. No. 5,208,920.

BACKGROUND OF THE INVENTION

This invention relates to the clothing arts and more specifically to a system that allows multiple adjustments to be made in sleeve and pant lengths. The system is fast and easy for anyone without tailoring skills to use, and the appearance of the garment is the same both before and after the adjustment. The system is particularly applicable to rental clothing (i.e., formal wear), since it frequently is necessary to adjust the length of the pant legs or jacket sleeves to conform to the individual's leg and/or arm length. However, the system also may be used to adjust the length of skirts, dresses and other items of clothing.

The traditional and typical method of adjusting the length of garments involves measuring the individual's inseam or outseam length (for pants) or arm length (from the nape of the neck in the center of the back, over the top of the shoulder down the arm to the wrist bone), and then to hem the garment to the predetermined length. To do this, the garment is folded inwardly until the desired length is reached and then this fold is stitched to the inside of the garment with a stitch such as the blind stitch. Next, the garment is usually pressed to provide a tailored edge.

This traditional method is costly, time-consuming and requires tailoring skills. Furthermore, each time an individual with different length arms and/or legs wears the garment, it is necessary to remove the stitching, readjust the length, and then restitch the hem and repress the garment.

Several solutions have been proposed using various means to effect the adjustment, such as hook and loop material (in either horizontal or vertical strips, or in circular patches), zippers and slide fasteners, permanent and removable stitching, and other fasteners such as snaps and buttons. See for example, U.S. Pat. Nos. 4,985,936; 4,896,379; 4,200,938; 4,573,218; 3,665,516; 4,259,751; 3,111,681; 3,156,928; 3,170,167; 4,241,461; and U.S. Pat. No. 4,149,275. One solution uses a detachable separately formed cuff. See U.S. Pat. No. 3,722,001. The Jones U.S. Pat. No. 4,985,936 uses a number of thin vertically elongated adjuster strips of the hook and loop variety attached to the inside of the garment (i.e., the pant leg). Four strips of the hook and loop material are attached to each pant leg. The garment is then folded to the proper length and the hook material is secured to the loop material.

None of these solutions has been adopted on a widespread commercial basis. The reason is believed to be because the bulk added by most fasteners is aesthetically unacceptable and the methods employing removable stitching make multiple adjustments tedious and require tailoring skills.

Therefore, it is the object of this invention to provide a system for the adjustment of garment length that can be used repeatedly, does not require any special tailoring skills, and does not add perceptible bulk to the garment.

One further object of this invention is to provide an adjustment system for garments which is integral with the garment itself and which is virtually concealed from the public or the wearer. It further allows the adjustment in the length of trouser legs, trouser waistbands, jacket sleeve lengths, jacket body length and skirt length in a very simple manner.

These and other advantages and objects of this invention will become apparent from the following disclosure and defined in the appended claims.

BRIEF DESCRIPTION OF THE INVENTION

There is disclosed herein a system and technique for multiple adjustment of a garment's length, specifically sleeve and pant length. The system employs an adjustment mechanism, which consists of a sturdy cord or thread (such as upholstery thread) or flat tape, which is attached at one end to the bottom of the cuff and then is threaded through a flexible channel (attached to the inside seam), looped, threaded back through the channel, and attached to the cuff near the place of first attachment. Preferably, the cord is then knotted above the channel, leaving a loop of the cord. A second adjustment mechanism may be similarly attached along the opposite inside seam.

A lightweight fabric full or partial lining is constructed in such a way as to conform to the circumference of the pant leg or jacket sleeve at the places of attachment thereto. The lining is cut long enough to accommodate the desired adjustment range, with enough additional fabric to cover the adjustment mechanism. A short, i.e., one inch (1"), lining window is installed near the top and adjacent to the seam area on both sides of the lining. The lining window may be rimmed with hook and loop material or other fastening means for ease of opening and closing. The lining is then sewn to the pant or sleeve around the bottom and top circumferences using a blind stitch, the top and a straight stitch at the bottom entirely covers the adjustment mechanism.

The adjustment mechanism also can be installed in the same 10 fashion in garments that are already lined, as long as lining windows are created. If the garment to be adjusted is a jacket it may be desirable to modify the lining by inserting a small strip of stretchy material, approximately two inches (2") wide, into the lining material, either above or below the lining window. This is especially helpful where the sleeve is wider at the top than at the bottom.

It has been found that this system provides an inexpensive, easy, effective, repeatable, and commercially acceptable system.

BRIEF DESCRIPTION OF THE DRAWING

This invention may be more clearly understood from the following detailed description and by reference to the drawing in which:

FIG. 4 is a perspective view of an adjustable pant leg in the fully lengthened position;

FIG. 5 is a vertical cross section view of the adjustment system illustrating the location of the adjustment mechanism in relation to the garment's exterior fabric and the lining;

FIG. 6 illustrates the lining window in its closed position, showing how the loop of the adjustment mechanism is hidden from view;

FIG. 7 illustrates how the loop of the adjustment mechanism is pulled through the lining window, with the lining window rimmed with hook and loop fastener material;

FIG. 8 illustrates a lining window that does not use a hook and loop fastener; and FIG. 9 illustrates the holding pocket and flexible channel of the adjustment mechanism, showing the use of a round cord, and the channel's attachment to the garment's inside inseam or outseam.

FIG. 13 is a front elevational view, partly broken away, of a man's tuxedo jacket or coat including jacket or coat length adjustment;

FIG. 14 is an enlarged fragmentary view of the length adjustment details of the garment of FIG. 13;

FIG. 15 is a perspective view of a young lady's skirt with portions broken away for clarity and adjusted by a concealed system to a short length;

FIG. 16 is a perspective view of the skirt FIG. 15 adjusted to a longer length and with portions broken away for clarity;

FIG. 17 is a fragmentary perspective view of the adjustment system employed in the skirt in FIGS. 15 and 16;

FIG. 18 is a side elevational view of a pair of casual trousers employing the adjustment system of FIGS. 2 through 4 but with the adjustment loop extending outside of the garment and preferably with a concealment pocket for the extended adjustment cord or tape;

FIG. 19 is a fragmentary perspective view of a pair of trousers with a waistband adjustment employing this invention;

FIG. 20 is a fragmentary vertical plan view of the waistband adjustment system of FIG. 19;

FIG. 21 is an enlarged detailed perspective view of the frictional engagement arrangement employed in this invention.

FIG. 22 is an enlarged detailed perspective view of the basic adjustment mechanism.

FIG. 23 is an enlarged detailed perspective view of the branched cord employed in theinvention.

DETAILED DESCRIPTION OF THE INVENTION

Figure 1A:
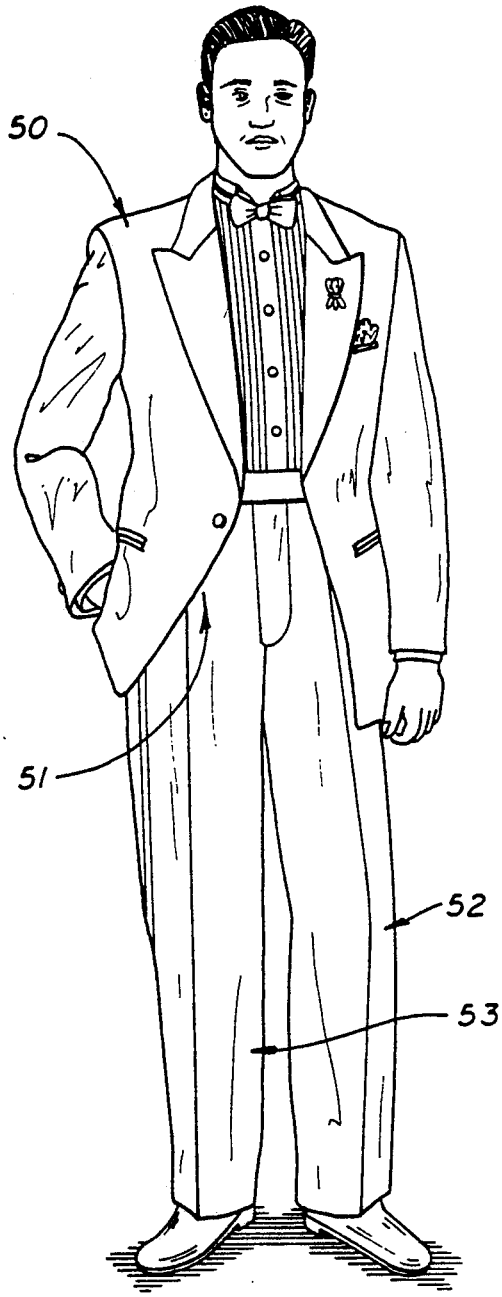
FIG. 1 is a view of two male figures (a) and (b), each of approximately the same build but with a several inch difference in height and arm length, wearing identical formal jackets and pants using the adjustment system of this invention showing the appearance upon wearing.
Figure 1B:
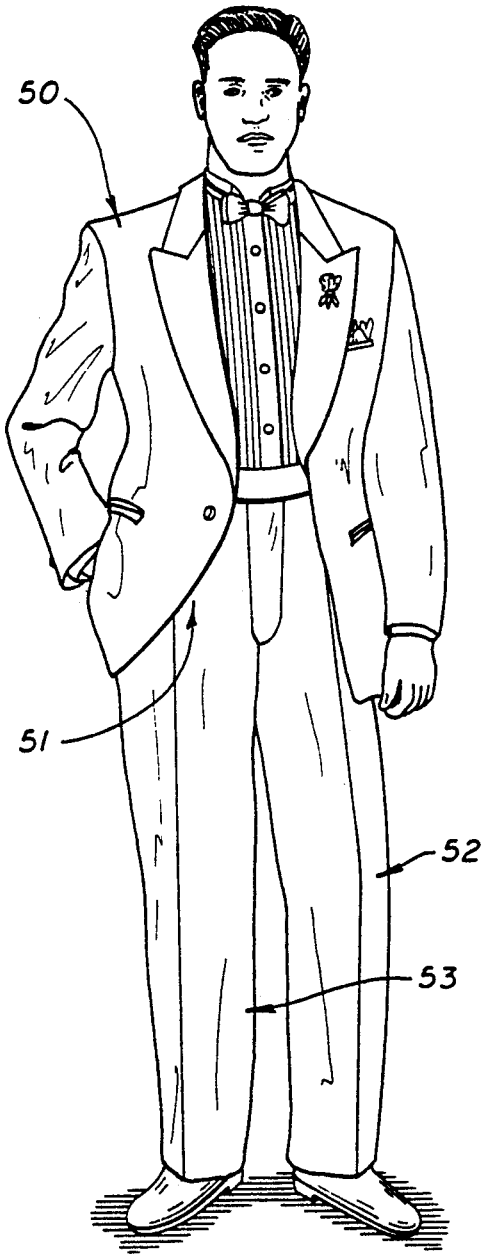

Referring now to the drawings, there is shown two male figures (a) and (b) generally of FIG. 1, both with approximately the same build but with a several inch difference in height and in arm length. These figures are wearing formal wear, consisting of a jacket 50 that has two sleeves and pants 51 that have two legs. Each leg of the pants has an outseam 52 and an inseam 53. Both have the length adjustment system in the sleeves and pant legs, but this system is invisible to both the wearer and the public.

The garments are donned in the usual manner without detection of the presence of the adjustment system. Virtually no additional bulk is detectable by the wearer. The adjustment between the two sizes, for example, 42 regular fitting someone 5'9" to 6'1" or 42S fitting 5'4" to 5'9½" or 42L fitting 5'11" to 6'5" depending on body type i.e., leg to torso ratio. The sleeve length in FIG. 1 changed by up to three inches (3") or any desired length in between and trouser lengths up to four inches (4") is a matter of a few minutes by non-tailor trained staff of the apparel or rental shop. Although illustrated in connection with formal apparel, it is also particularly suitable for clothing for growing adolescents.

Figure 2:
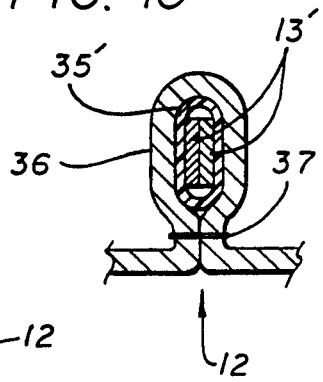
FIG. 2 is a perspective view of an adjustable sleeve in the fully lengthened position.

Referring now to FIG. 2, in which a jacket sleeve end 10 is shown, the exterior 11 is unchanged. The adjustment mechanism is located within the lining 21, which is stitched in its normal end. The sleeve's normal outer side seam 12 is shown in the broken away region.

Secured as by stitching of the seam 14 between the end of the reverse fold 15 and the lining 21 is a cord 13 that extends through a flexible channel 35 enclosed within a holding pocket 36 secured to the seam 12 material and invisible from either the exterior or the interior of the sleeve. The upper end of the cord 13 is formed into a loop 16 and knotted 20. The lining 21 contains a small lining window 22 through which the loop 16 of the adjustment mechanism may be reached for adjustment purposes. In the sleeve in FIG. 2, a small piece of stretchy material 30, having the same general circumference as the sleeve, has been inserted in the lining directly above or below the lining window 22. The lining window 22 is rimmed with hook and loop material 23 for closure purposes.

Figure 10:
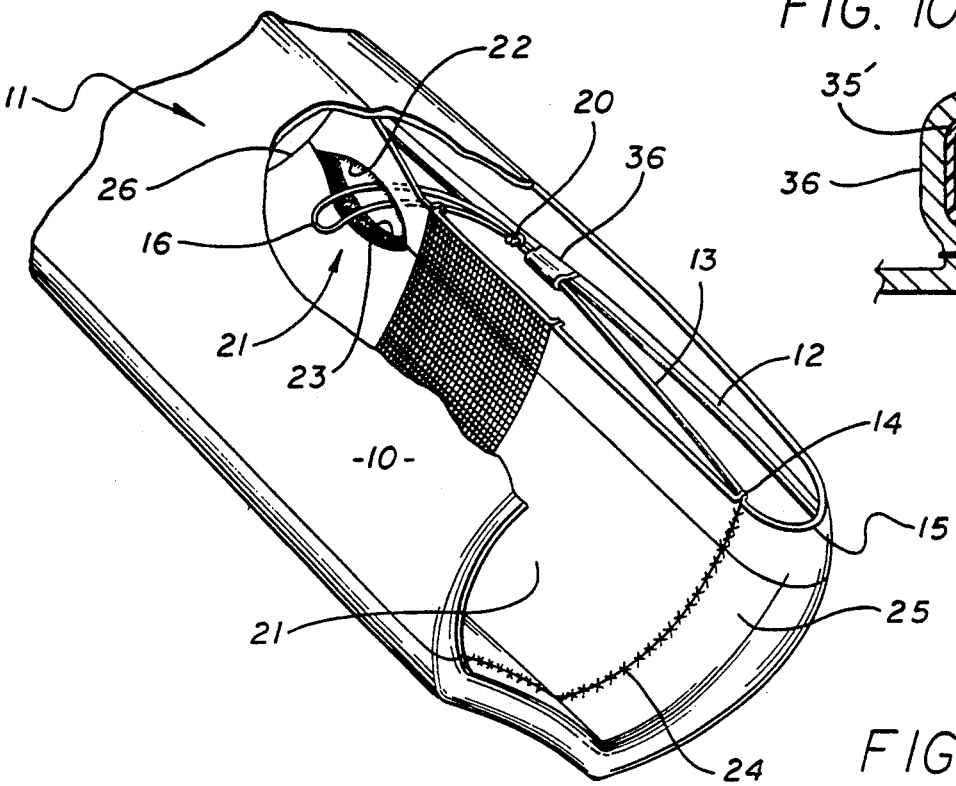
FIG. 10 is a transverse section through the flexible channel and seam of a garment with a flat tape cord used for size adjustment.

To install this invention on existing garments, in FIG. 2, the jacket's sleeve 10 is first turned inside out. Next, a sturdy cord or thread 13 (such as upholstery thread) or a flat tape (see FIG. 10), is securely attached at one end 14 to the original hem 25 of the jacket sleeve 10 along the sleeve's inside seam 12. The cord 13 is then threaded through a flexible channel 35 made of a length of soft plastic tubing (such as PVC) or of fabric. The flexible channel 35 has been previously enclosed in a holding pooket 36, consisting of a small rectangular piece of material, such as iron-on material, that has been also sewn for additional security, wrapped around the flexible channel 35 as in FIG. 9. The holding pocket is securely attached 37 FIG. 9 to the sleeve's inside seam 12 some inches up from the original hem 25, as shown in FIG. 2.

Figure 3:
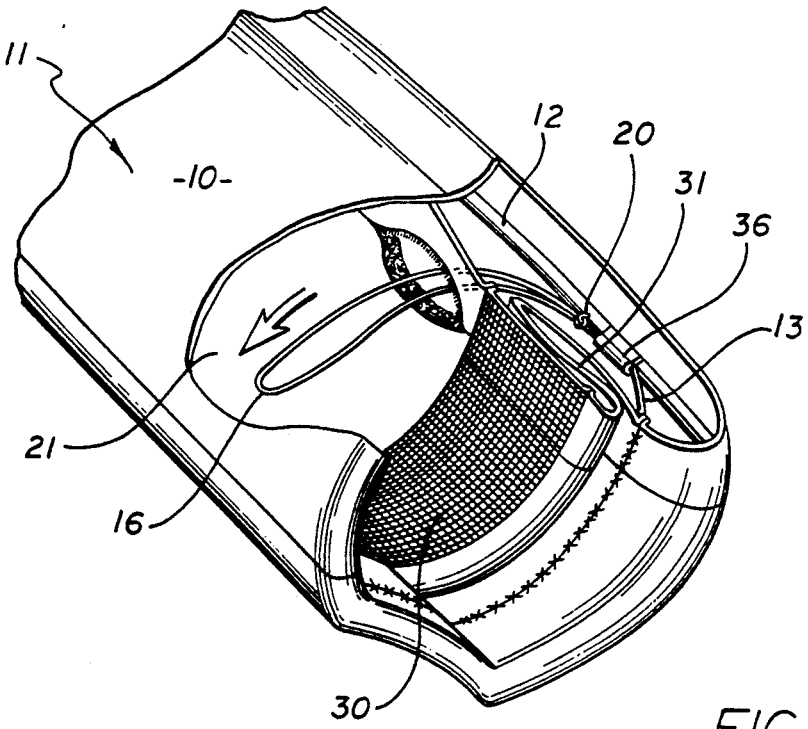
FIG. 3 is a perspective view of an adjustable sleeve in a shortened, post-adjustment position.

After the cord 13 has been threaded through the channel 35, the cord 13 is formed into a loop 16, threaded back through the channel, and attached to the sleeve's inside hem 14. The loop 16 of cord 13 is then knotted 20 above the holding pocket 35. This knot 20 prevents the cord 13 from slipping back through the channel 35, and keeps the loop 16 above that channel. This constitutes the adjustment mechanism 13, 16, 20, 35, 36, 37. An identical adjustment mechanism 13, 16, 20, 35, 36, 37 should be installed on the opposite inside seam. FIGS. 2 and 3 show the end loops of the opposite seam adjustment mechanism.

The friction between the channel 35 and the cord 13 creates the force which keeps the cord 13 in place once an adjustment has been made. See FIG. 9. The channel 35 and the holding pocket 36 also serve as a guide to the cord 13.

A small rectangular piece of fabric lining 21 is cut to dimensions that conform to the circumference of the jacket sleeve 10 at the places where the lining will be attached 24, 26 to the sleeve 10. The length of the lining 21 should, at least, correspond to the maximum number of inches of adjustment that the user desires, with enough additional fabric lining 21 to cover the adjustment mechanism 13, 16, 20, 35, 36, 37. Since sleeves are normally lined, the existing lining will be used.

A small, i.e., one inch (1"), lining window 22 is cut into the fabric lining 21 seam near the top of the fabric lining 21 and adjacent to the seam 17 area on both sides of the fabric lining 21 (i.e., near each seam of the sleeve). In FIG. 7, hook and loop fastener material 23 has been attached to the edges of the lining window 22 for ease of opening and closing. In FIG. 8, no hook and loop fastener material 23 has been attached to the lining window 22. Instead, the lining window 22 has been left as a small slit in the seam 17 of the fabric lining 21.

The fabric lining 21 is then securely attached around the circumference of the sleeve 10 to the original hem 25 at the bottom of the sleeve 10, and to the fabric inside the sleeve 26 at an area above the holding pocket 36. The fabric lining 21 should be stretched taut up the inside of the sleeve 10 before the top attachment is made. The fabric lining 21 should entirely cover the adjustment mechanism 13, 16, 20, 35, 36, 37. Note that the adjustment mechanism 13, 16, 20, 35, 36, 37 is entirely hidden between the fabric lining 21 and the exterior fabric 11, except the loop 16 of the adjustment mechanism that temporarily has been pulled through the lining window 22.

While exerpimenting with this invention and in developing more familiarity with it, we discovered that it was possible, employing a bit of manual dexterity, to make an adjustment of the length of a garment without ever fishing for the adjustment cord through the opening, pulling it to make the length adjustment and returning the adjustment cord through the opening in the lining. With our familiarity with the system, we could feel the cord through the lining above the friction member and while holding the correct length of the garment with one hand, pull the adjusting cord sufficiently to make the required adjustment and then reach over to the other side of the garment, for example, the inseam of a trouser, feel the adjustment cord through the lining, pull to make the appropriate adjustment to the opposite side. The length of the garment has then been changed to the required amount. The adjustment cord remained between the lining and the garment's outer fabric at all times. It was perfectly satisfactory for the skilled garment adjuster.

Upon further reflection we determined that the upper end of the adjusting cord need never be touched at all and no feeling for the cord was required if the formerly free end of the cord were attached at a predetermined location to the lining and the lining itself was pulled in that region to make the adjustment.

To make the system even more effective, we secured a small fabric tab within the lining, unnoticed to the wearer, but easily to be found by sight or feel in the garment and the adjustment could be made merely by holding the garment at the desied length and pulling on the tab with the other hand. The direction of pull to make the adjustment is usually away from the end of the garment to be adjusted when shortening the garment.

Therefore we determined that the addition of some way of securing the adjustment device in a known position between the lining and garment fabric, adjustments can easily be made. The owner or consumer can make an adjustment when he is merely informed of the purpose of the tab and the correct direction to pull for length adjustment. Dual tabs allow both lengthening and shortening the garment by selecting and pulling the designated tab in the correct direction.

Figure 11:
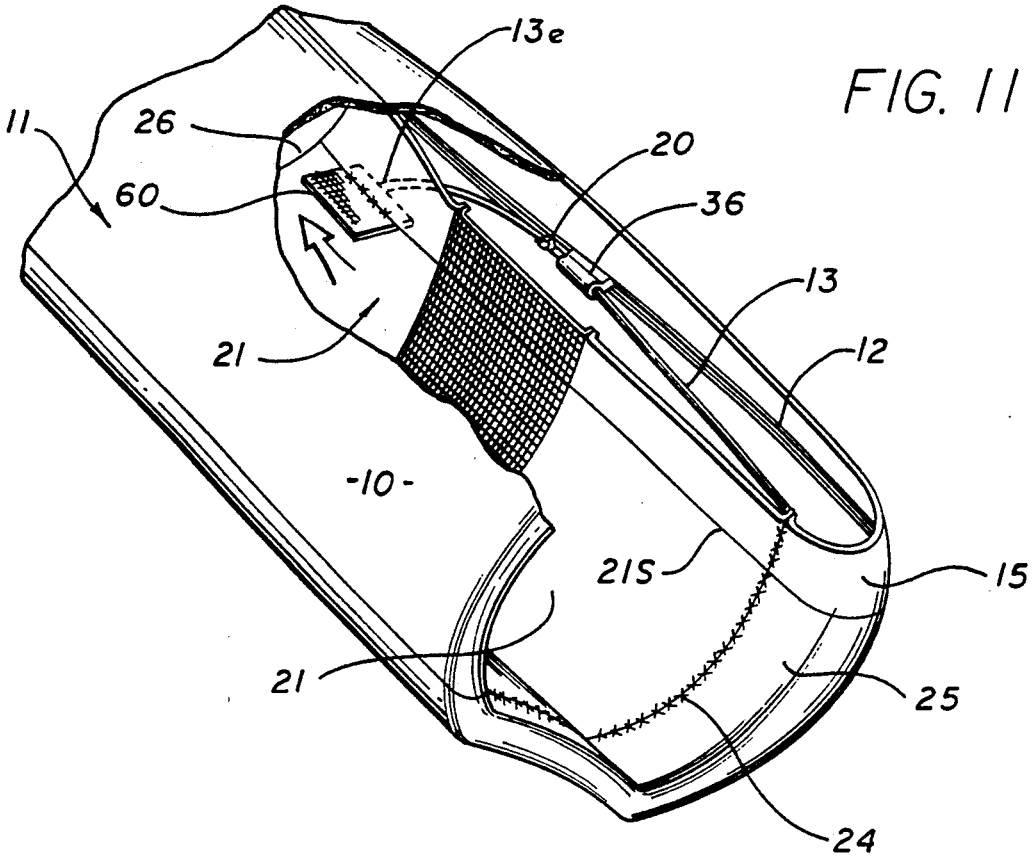
FIG. 11 is a fragmentary perspective view of an alternate configuration of this invention in which the adjustment means, namely the cord and its attachment, are all concealed within the lining of the garment with only a tab showing.
Figure 12:
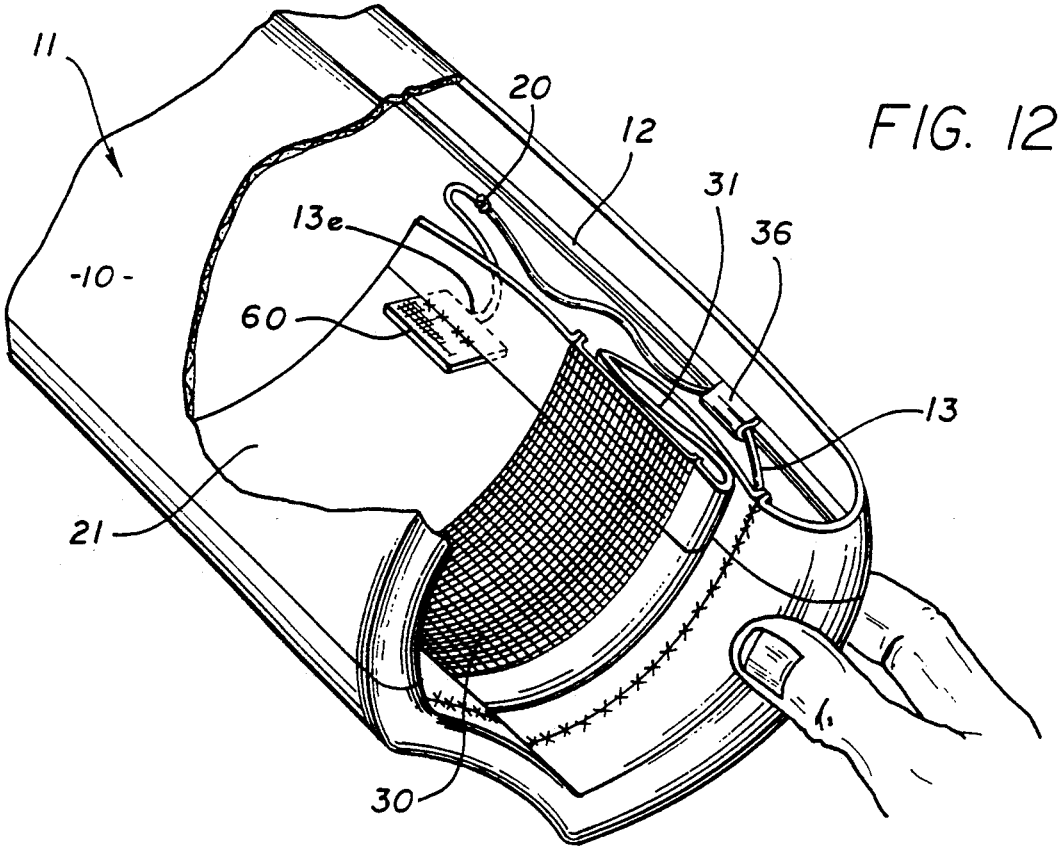
FIG. 12 is a fragmentary perspective view of the garment of FIG. 11 shown adjusted in its shortest length employing the new concealed adjustment feature.

The preferred embodiment of this invention can be seen in FIGS. 11 and 12 in which the entire adjusting mechanism including the cord 13, holding pocket 36, and the stop knot 20, all totally concealed between lining 21 and the exterior fabric 11. The only portion of the adjustment mechanism appearing is a small fabric tab 60 which is sewn in the lining seam 21 as best seen in FIG. 11. The formerly looped or free end 13*e* of cord 13 of FIG. 3 is secured, as by sewing, to the inner end of tab 60 as it extends into the area between lining 21 and exterior fabric 11.

The tab 60, preferably of fabric, is hardly noticed by the wearer but is the only exposed portion of the adjustment mechanism which needs to be touched in making the adjustment. The tab 60 is of appropriate size to allow it to be grasped between thumb and forefinger while the base of the sleeve or garment are held in the other thumb and forefinger. The tab 60 is then pulled wav from the end of the garment and the sleeve shortening adjustment is made.

To lengthen the sleeve or garment part, the lining 21 can be grasped at any area near the end and pulled outward until the correct length is reached. In the embodiment of FIG. 22 a second tab is used for lengthening. Both of the tabs serve as indicators for the place to pull to make an adjustment. A light pressing of the adjusted length is often desirable to provide a finished look for the garment.

Characteristic of this embodiment is the fact that the adjusting cord remains totally inside the lining next to the exterior fabric and is therefore never seen nor is there any danger of entanglement in putting on or removing the garment. In fact, as indicated above, the adjustment may be made by merely feeling the cord between the holding pocket and the tab and pulled to shorten the garment.

While further exploring this improved concealed adjustment we determined that it is possible to make further adjustments in garments for example the length of a jacket or the length of a lady's skirt where there are few seams close together as in the case of a sleeve or a trouser leg. Also, we determined that it is possible to make an effective adjustment for waistbands of garments such as trousers or skirts.

Examples of the application of this invention to the length of jackets is illustrated in FIGS. 13 and 14 the length of skirts in FIGS. 15 through 17.

Now referring to these FIGS. 13 and 14, a man's jacket is shown opened with the lining 21 facing the viewer. The only portions of the body of the garment seen in this version are the collar 62 and the underfold 64 along both sides.

In this case, a pair of seam 61*s* and 62*s* are present in the lining 21 and additional seams 63*s* and 64*s* appear at the junction the underfold 64 and the lining 21. Visible are four tabs 60 of at the seam lines. These tabs 60 are better viewed in FIG. 14 as they are stitched to the seam line 61s while the holding pocket 36 is stitched to the seam of the garment body 61. The cord 13 includes a stop knot 20 as in the other embodiments. Characteristic of the embodiment of the invention which allows it to be applied to larger areas of the garment the fact that cord 13 includes one or two branch cords 13b and 13c in FIGS. 13 and 14. These branch cords are of sufficient length such that they will draw rather evenly when the cord 13 is drawn upward by a pull on the tab 60.

By review of FIG. 13 it can be seen that by employing only four tabs 60 where the outer most two tabs 60 are connected to single cords and the inner two tabs 60 re each connected to three cord 13. The body of the jacket or coat is shortened at points a, b and c by the tab 60 on seam 61s and shortened at d, e and f by tab 60 on seam 62s and further shortened by drawing upward on the outer most tab 60 for a total of eight locations around the bottom of the body of the garment. A light pressing will provide a finished look to the adjusted length of the body. The sleeves which are largely hidden behind the body in its open position may similarly be adjusted as described in connection with FIGS. 11 and 12.

This invention applied to ladies skirts may be seen in FIGS. 15 through 17 in which a skirt having a fabric 70 as well as a waistband 71, and a waist closure 72. The skirt is either fully or partially lined as denoted by reference number 74.

The partial lining in the skirts or trousers may be partial from the bottom seam or merely covering the adjustment mechanism. Characteristically skirts do not have many or closely spaced seams suitable for installation of adjustment mechanisms as in trousers legs or sleeves. Therefore the multi-cord arrangement as shown in FIG. 17, in which cord 13 has ranch cores 13b and 13c will allow the adjustment of the length of the skirt by up to four inches merely by the installation of two or three adjustment tabs, example in a size $\frac{7}{8}$ plain skirt. This feature for skirts is particularly valuable in the food service industry where servers are expected to wear properly fitting skirt. The same skirt may be inventoried for wear by different servers either on different shifts or at different periods of employment.

This invention is applied to skirts also allows a lady to adjust the length of her skirt to meet changes in fashion merely by a pull of a few tabs followed by light pressing.

In connection with the development of this invention, we further found that it is possible to employ the invention in trousers in two different modes than previously discussed. The first variation appears in FIG. 18. For casual trouser wear, it is possible to adjust the length of trouser legs where the adjustment cord 83 extends through an opening or grommet 82 and is adjusted merely by pulling on the cord 82 loop to shorten the trousers followed by tucking the excess cord into pocket 84 to keep it out of sight. This type of adjustment, for example, for use on weather gear by various persons allows rapid adjustment and to avoid overlay long trousers for safety and comfort reasons.

We have also found that the waistband of skirts or trousers may be adjusted employing a variation of this invention. Such is disclosed in FIG. 19 in which a pair of trousers 80 have a waistband 81, a normal fly 85 and a pocket 86. The fly 85 may not have any adjustment with all adjustments taken up at one or both sides of the trousers adjacent to its side pockets. In the embodiment of FIG. 19 the trousers are shown with a single side adjustment.

Referring particularly to FIG. 20 it may be seen that the waistband 81 extends around and overlaps at the wearer's right side. On the outer face of the inner end of waistband 81, a cord 13 is secured at both ends 90 and 91 as by stitching and has free length in between. The inner face of the mating of portion of waistband 81 includes the holding pocket 36 which encircles the cord 13. The cord 13 extends along the length of one overlapping section of the waistband and is exposed to a frictional engaging member through an elongated opening or slit in the waistband. Typically waistbands have multiple layers and the cord 13 may be concealed between layers but accessible through the slit 84. The frictional engagement of the cord with the tube 35 as shown in FIG. 20 but best appearing in FIG. 21 provides resistance to movement of the two sections of the waistband. By grasping the two sections and pulling on the waistband it may be adjusted in overall length as much as two or three inches. The adjustment may be totally concealed or depending on the overlap or have only a slightly visible as a slit 87 appearing in FIG. 19. The same mechanism may be applied to skirt waistbands.

FIGS. 21 and 22 show the basic adjustment mechanism used. In FIG. 21, the assembly may be sewn into existing garments. This is done by opening a lining sleeve, sewing holder 36 to a body seam and tabs 60 to the lining seam and resewing the lining seam. FIG. 22 shows a branched cord.

With the foregoing variations in our invention we have been able to provide a method of adjustment useful by the consumer and one which is totally concealed except for the finger tab. We have also afforded the adjustment of portions of garments which heretofore have been adjusted only through sewing.

With jacket sleeves, it may be desirable to modify the lining 21 by removing a strip of the lining 21 approximately two inches (2") wide and inserting therein a similarly sized stretch fabric panel 30 made of stretchy material. This insertion is made directly above or below the lining window 22. This stretch fabric panel 30 is especially helpful where the sleeve 10 is wider at the top than at the bottom.

FIG. 2 shows how the system is attached to a jacket sleeve. FIG. 4 shows how the system is attached to a pant leg. FIG. 5 is a cross-section view of the system as installed in a pant leg. The structure of the leg adjustment is nearly identical with that of the sleeve and the same reference numerals have been used to denote identical elements.

In FIG. 4, a pant leg 40, the exterior 11 is unchanged. The adjustment mechanism is located within the lining 21, which is stitched in its normal manner to the reverse fold 15 of the pant leg end. The leg's normal outer side seam 12 is shown in the broken away region.

Secured as by stitching of the seam 14 between the end of the reverse fold 15 and the lining 21 is a cord 13 that extends through a flexible channel 35 enclosed within a holding pocket 36 secured to the seam 12 material and invisible from either the exterior or the interior of the sleeve. The upper end of the cord 13 is formed into a loop 16 and knotted 20. The lining 21 contains a small lining window 22 through which the loop 16 of the adjustment mechanism may be reached for adjustment purposes. The lining window 22 is rimmed with hook and loop material 23 for closure purposes.

To install this invention on existing garments, in FIG. 4, the pant's leg 40 is first turned inside out. Next, a sturdy cord or thread 13 (such as upholstery thread) or a flat tape (see FIG. 10), is securely attached at one end 14 to the original hem 25 of the pant's leg 40 along the leg's side seam 12. The cord 13 is then threaded through a flexible channel 35 made of a length of soft plastic tubing (such as PVC) or of fabric. The flexible channel 35 has been previously enclosed in a holding pocket 36, consisting of a small rectangular piece of material, such as iron-on material, that has been wrapped around the flexible channel 35 as in FIG. 9. The holding pocket is securely attached 37 FIG. 9 to the sleeve's inside seam 12 some inches up from the original hem 25, as shown in FIG. 4.

The cord 13 is formed into a loop 16, and threaded through the channel, and attached to the pant leg's inside hem 14. The loop 16 of cord 13 is then knotted 20 above the holding pocket 35. This knot 20 prevents the cord 13 from slipping back through the channel 35, and keeps the loop 16 above that channel. This constitutes the adjustment mechanism 13, 16, 20, 35, 36, 37. An identical adjustment mechanism 13, 16, 20, 35, 36, 37 should be installed on the opposite inside seam. FIG. 4 shows the end loop of the opposite seam adjustment mechanism.

The friction between the channel 35 and the cord 13 creates the force which keeps the cord 13 in place once an adjustment has been made. See FIG. 9. The channel 35 and the holding pocket 36 also serve as a guide to the cord 13.

A small rectangular piece of fabric lining 21 is cut to dimensions that conform to the circumference of the pant leg 40 at the places where the lining will be attached 24, 26 to the leg 40. The length of the lining 21 should, at least, correspond to the maximum number of inches of adjustment that the user desires, with enough additional fabric lining 21 to cover the adjustment mechanism 13, 16, 20, 35, 36, 37.

A small, i.e., one inch (1"), lining window 22 is cut into the fabric lining 21 seam near the top of the fabric lining 21 and adjacent to the seam 17 area on both sides of the fabric lining 21 (i.e., near each seam of the sleeve). In FIG. 7, hook and loop fastener material 23 has been attached to the edges of the lining window 22 for ease of opening and closing. In FIG. 8, no hook and loop fastener material 23 has been attached to the lining window 22. Instead, the lining window 22 has been left as a small slit in the seam 17 of the fabric lining 21.

The fabric lining 21 is then securely attached around the circumference of the pant leg 40 to the original hem 25 at the bottom of the leg 40, and to the fabric inside the leg 26 at an area above the holding pocket 36. The fabric lining 21 should be stretched taut up the inside of the leg 40 before the top attachment is made. The fabric lining 21 should entirely cover the adjustment mechanism 13, 16, 20, 35, 36, 37. Note that the adjustment mechanism 13, 16, 20, 35, 36, 37 is entirely hidden between the fabric lining 21 and the exterior fabric 11, except the loop 16 of the adjustment mechanism that temporarily has been pulled through the lining window 22.

The aforementioned steps need only be done once on each seam for each garment to modify it for future adjustments.

In use on a pant leg, the individual's inseam (crotch to instep) or outseam (top of the waistband to top of the heel of the shoe) is measured. In use on a jacket sleeve, the individual's arm length is measured (from the nape of the neck in the center of the back, over the top of the shoulder down the arm to the wrist bone). The jacket sleeve or pant leg is turned inside out for adjustment. With a sleeve, the sleeve length of the jacket is then measured to the correct dimension. The lining window 22 is opened and the adjuster reaches into it and pulls out the loop 16 of the adjustment mechanism.

If the sleeve is to be shortened, the loop 16 of the cord 13 is gently pulled until the original hem 25 has pulled the exterior fabric 11 of the sleeve around to approximately the length desired. The adjuster may measure the desired length of the sleeve and pin where necessary, if preferred. Once the proper length has been reached, all slack taken out of the loop below the channel, the loop 16 should be reinserted into the lining window 22, and the lining window should be closed. See FIG. 6. The end of the sleeve or pant leg is then lightly pressed.

The fabric lining 21 may tend to bunch up and the sleeve 10 with the attached fabric lining 21 should be neatly folded to the desired length. This will cause the fabric lining 21 to blouse 31 as illustrated in FIG. 3, which shows the sleeve 10 after the adjustment has been made and the sleeve 10 has been shortened. The adjuster should then turn the sleeve right side out and press it. To insure a more normal interaction with the wearer, a finishing button can be sewn in place to attach the fabric lining 21 to the base of the cuff. Such an attachment also may be achieved with "no-sew" options already on the market.

To lengthen a sleeve that has been shortened using this system, the adjuster should turn the sleeve inside out, open the lining window 22, reach into it and pull out the loop 16 of the adjustment mechanism. While holding the loop 16, the adjuster should pull on the hem of the sleeve, unrolling it to the desired length; verify length measurement and possibly pin the garment before pressing. Once the proper length has been reached, the loop 16 should be reinserted into the lining window 22, and the lining window should be closed. See FIG. 6. The adjuster should turn the sleeve right side out and press it.

A similar procedure is followed to shorten or lengthen pant legs that use this system.

While experimenting with this invention and in developing more familiarity with it, we discovered that it was possible, employing a bit of manual dexterity, to make an adjustment of the length of a garment without ever fishing for the adjustment cord through the opening, pulling it to make the length adjustment and returning the adjustment cord through the opening in the lining. With our familiarity with the system, we could feel the cord through the lining above the friction member and while holding the correct length of the garment with one hand, pull the adjusting cord sufficiently to make the required adjustment and then reach over to the other side of the garment, for example, the inseam of a trouser, feel the adjustment cord through the lining, pull to make the appropriate adjustment to the opposite side. The length of the garment has then been changed to the required amount. The adjustment cord remained between the lining and the garment's outer fabric at all times. It was perfectly satisfactory for the skilled garment adjuster.

Upon further reflection we determined that the upper end of the adjusting cord need never be touched at all and no feeling for the cord was required if the formerly free end of the cord were attached at a predetermined location to the lining and the lining itself was pulled in that region to make the adjustment.

To make the system even more effective, we secured a small fabric tab within the lining, unnoticed to the wearer, but easily to be found by sight or feel in the garment and the adjustment could be made merely by holding the garment at the desired length and pulling on the tab with the other hand. The direction of pull to make the adjustment is usually away from the end of the garment to be adjusted when shortening the garment.

Therefore we determined that with the addition of some way of securing the adjustment device in a known position between the lining and garment fabric, adjustments can easily be made. The owner or consumer can make an adjustment when he is merely informed of the purpose of the tab and the correct direction to pull for length adjustment. Dual tabs allow both lengthening and shortening the garment by selecting and pulling the designated tab in the correct direction.

The preferred embodiment of this invention can be seen in FIGS. 11 and 12 in which the entire adjusting mechanism including the cord 13, holding pocket 36, and the stop knot 20, are all totally concealed between lining 21 and the exterior fabric 11. The only portion of the adjustment mechanism appearing is a small fabric tab 60 which is sewn in the lining seam 21 as best seen in FIG. 11. The formerly looped or free end 13*e* of cord 13 of FIG. 3 is secured, as by sewing, to the inner end of tab 60 as it extends into the area between lining 21 and exterior fabric 11.

The tab 60, preferably of fabric, is hardly noticed by the wearer but is the only exposed portion of the adjustment mechanism which needs to be touched in making the adjustment. The tab 60 is of appropriate size to allow it to be grasped between thumb and forefinger while the base of the sleeve or garment are held in the other thumb and forefinger. The tab 60 is then pulled away from the end of the garment and the sleeve shortening adjustment is made.

To lengthen the sleeve or garment part, the lining 21 can be grasped at any area near the end and pulled outward until the correct length is reached. In the embodiment of FIG. 22 a second tab is used for lengthening. Both of the tabs serve as indicators for the place to pull to make an adjustment. A light pressing of the adjusted length is often desirable to provide a finished look for the garment.

Characteristic of this embodiment is the fact that the adjusting cord remains totally inside the lining next to the exterior fabric and is therefore never seen nor is there any danger of entanglement in putting on or removing the garment. In fact, as indicated above, the adjustment may be made by merely feeling the cord between the holding pocket and the tab and pulling to shorten the garment.

While further exploring this improved concealed adjustment we determined that it is possible to make further adjustments in garments; for example, the length of a jacket or the length of a lady's skirt where there are few seams close together as in the case of a sleeve or a trouser leg. Also, we determined that it is possible to make an effective adjustment for waistbands of garments such as trousers or skirts.

Examples of the application of this invention to the length of jackets is illustrated in FIGS. 13 and 14 the length of skirts in FIGS. 15 through 17.

Now referring to these FIGS. 13 and 14, a man's jacket is shown opened with the lining 21 facing the viewer. The only portions of the body of the garment seen in this version are the collar 62 and the underfold 64 along both sides.

In this case, a pair of seams 61*s* and 62*s* are present in the lining 21 and additional seams 63*s* and 64*s* appear at the junction of the underfold 64 and the lining 21. Visible are four tabs 60 at the seam lines. These tabs 60 are better viewed in FIG. 14 as they are stitched to the seam line 61*s* while the holding pocket 36 is stitched to the seam of the garment body 61. The cord 13 includes a stop knot 20 as in the other embodiments. Characteristic of the embodiment of the invention which allows it to be applied to larger areas of the garment the fact that cord 13 includes one or two branch cords 13*b* and 13*c* in FIGS. 13 and 14. These branch cords are of sufficient length such that they will draw rather evenly when the cord 13 is drawn upward by a pull on the tab 60.

By review of FIG. 13 it can be seen that by employing only four tabs 60 where the outer most two tabs 60 are connected to single cords and the inner two tabs 60 are each connected to three cord 13. The body of the jacket or coat is shortened at points a, b and c by the tab 60 on seam 61*s* and shortened at d, e and f by tab 60 on seam 62*s* and further shortened by drawing upward on the outer most tab 60 for a total of eight locations around the bottom of the body of the garment. A light pressing will provide a finished look to the adjusted length of the body. The sleeves which are largely hidden behind the body in its open position may similarly be adjusted as described in connection with FIGS. 11 and 12.

This invention applied to ladies skirts may be seen in FIGS. 15 through 17 in which a skirt having a fabric 70 as well as a waistband 71, and a waist closure 72. The skirt is either fully or partially lined as denoted by reference number 74. Characteristically skirts do not have many or closely spaced seams suitable for installation of adjustment mechanisms as in trouser legs or sleeves. Therefore the multi-cord arrangement as shown in FIG. 17, in which cord 13 has branch cords 13*b* and 13*c* will allow the adjustment of the length of the skirt by up to four inches merely by the installation of two or three adjustment tabs, for example in a size $\frac{7}{8}$ plain skirt. This feature for skirts is particularly valuable in the food service industry where servers are expected to wear properly fitting skirt. The same skirt may be inventoried for wear by different servers either on different shifts or at different periods of employment.

This invention is applied to skirts also allows a lady to adjust the length of her skirt to meet changes in fashion merely by a pull of a few tabs followed by light pressing.

In connection with the development of this invention, we further found that it is possible to employ the invention in trousers in two different modes than previously discussed. The first variation appears in FIG. 18. For casual trouser wear, it is possible to adjust the length of trouser legs where the adjustment cord 83 extends through an opening or grommet 82 and is adjusted merely by pulling on the cord 82 loop to shorten the trousers followed by tucking the excess cord into pocket 84 to keep it out of sight. This type of adjustment, for example, for use on weather gear by various persons allows rapid adjustment and to avoid overlay long trousers for safety and comfort reasons.

We have also found that the waistband of skirts or trousers may be adjusted employing a variation of this invention. Such is disclosed in FIG. 19 in which a pair of trousers 80 have a waistband 81, a normal fly 85 and a pocket 86. The fly 85 may not have any adjustment with all adjustments taken up at one or both sides of the trousers adjacent to its side pockets. In the embodiment of FIG. 19 the trousers are shown with a single side adjustment.

Referring particularly to FIG. 20 it may be seen that the waistband 81 extends around and overlaps at the wearer's right side. On the outer face of the inner end of waistband 81, a cord 13 is secured at both ends 90 and 91 as by stitching and has free length in between. The inner face of the mating of portion of waistband 81 includes the holding pocket 36 which encircles the cord 13. The cord 13 extends along the length of one overlapping section of the waistband and is exposed to a frictional engaging member 35 (FIG. 21) through an elongated opening or slit 87 in the waistband. Typically waistbands have multiple layers and the cord 13 may be concealed between layers but accessible through the slit 87. The frictional engagement of the cord with the tube 35 as shown in Fig. 20 but best appearing in FIG. 21 provides resistance to movement of the two sections of the waistband. By grasping the two sections and pulling on the waistband it may be adjusted in overall length as much as two or three inches. The adjustment may be totally concealed depending on the overlap or be only slightly visible as a slit 87 appearing in FIG. 19. The same mechanism may be applied to skirt waistbands.

FIGS. 21 and 22 show the basic adjustment mechanism used. In FIG. 21, the assembly may be sewn into existing garments. This is done by opening a lining sleeve, sewing holder 36 to a body seam and tabs 60 to the lining seam and resewing the lining seam. Fig. 23 shows a branched cord.

With the foregoing variations in our invention we have been able to provide a method of adjustment useful by the consumer and one which is totally concealed except for the finger tab. We have also afforded the adjustment of portions of garments which heretofore have been adjusted only through sewing.

The above described embodiments of the present invention are merely descriptive of its principles and are not to be considered limiting. The scope of the present invention instead shall be determined from the scope of the following claims including their equivalents.

What is claimed is:

1. A garment adjustment mechanism for securing within a lined or partially lined garment for adjusting the length of a portion of the garment comprising:

an elongated flexible member including a first end for connection to the garment near the position to be adjusted in length, a second end for connection to the lining of the garment at a position remote from the first end and generally along a seam of the garment and having an intermediate flexible portion extending a length of at least as great as the amount of adjustment sought for the garment;

friction means comprising an elongated tube encircling said flexible member engaging the intermediate portion of the flexible member for restricting the movement of the flexible member through the engagement of the friction means; and means for securing said elongated tube to said garment;

whereby grasping the lining adjacent to said second end of said flexible means and pulling a length of said flexible means through said friction means changes the length of said flexible means on each side of said friction means and thereby to change the length of the garment portion connected to the first end of said flexible means.

2. A garment adjustment mechanism in accordance with claim 1 wherein said flexible member is a cord.

3. A garment adjustment mechanism in accordance with claim 1 including means for engaging said second end comprising a tab secured to said second end and said lining and of sufficient size to be graspable by the thumb and forefinger to allow the flexible member to be pulled through said elongated tube to affect adjustment of the length of a garment.

4. A garment adjustment mechanism in accordance with claim 3 including second engaging means secured to the opposite end from the first engaging means to allow adjustment of the garment length in the opposite direction from the first engaging means.

5. A garment adjustment mechanism in accordance with claim 1 wherein said flexible member is branched at the first end region whereby the branch ends may be secured to the garment at a plurality of spaced locations all of which are adjusted in length when the intermediate portion of said flexible member is adjusted in position with respect to said friction means.

6. A garment adjustment mechanism in accordance with claim 5 wherein said flexible member is a branched cord.

7. An adjustable length garment including a garment fabric body and at least a partial lining of fabric, the body and lining having one or more seams running generally in the direction of desired adjustment and the lining sewn to an underlapped portion of the body wherein the adjustment of the length of the garment is provided by an adjustment mechanism comprising;

an elongated flexible member having a first end secured to the garment in the region of the underlap;

an intermediate portion and a second end secured to said lining in the region of a lining seam;

friction means engaging said intermediate portion, said friction means secured to a seam region of said garment body adjacent to a seam in said lining;

said elongated flexible member being located between the garment body and the garment lining and thereby not visible to the wearer and whereby pulling of the lining in the region of the second end of said flexible member adjusts the length of the garment in the region of said seams.

8. A garment adjustment mechanism in accordance with claim 7 wherein said flexible means is a cord.

9. A garment adjustment mechanism in accordance with claim 8 wherein said friction means comprises a tube encircling said cord and includes means for holding said tube and for sewing the tube to a seam in the garment body.

10. A garment adjustment mechanism in accordance with claim 7 including indicator means attached to said lining and visible within the lined garment to show the location of the second end of said flexible means.

11. A said indicator means comprises a tab attached to said claim 10 wherein said indicator means comprises a tab attached to said lining and said second end region of said flexible member.

12. A garment adjustment mechanism in accordance with claim 11 wherein said tab is of sufficient size to allow the tab to be grasped by the thumb and forefinger and pulled generally in the direction of the intended length adjustment to make the garment length adjustment.

13. A garment adjustment mechanism in accordance with claim 10 including second indicator means secured to said garment in the region of said first end and visible within the lined garment.

14. A garment adjustment mechanism in accordance with claim 13 wherein said second indicator comprises a tab attached to said lining.

15. A garment adjustment mechanism in accordance with claim 7 wherein said garment is a pair of trousers and at least the lower portions of the legs of the trousers adjacent to the seams thereof are lined and said adjustment means is concealed within the trouser leg lining.

16. A garment adjustment mechanism in accordance with claim 7 wherein said garment is a skirt and at least a portion of the skirt is lined and said skirt has at least one lining seam extending generally in the direction of desired adjustment and wherein said adjusting mechanism is secured to said garment in the region of said lining seam.

17. A garment adjustment mechanism in accordance with claim 16 wherein said adjusting mechanism flexible member comprises a branched cord with the branches thereof secured to the skirt at spaced locations between the lining and the skirt body.

18. An adjustable length waistband of a garment including a waistband, a pair of overlapping sections of wasitband with sufficient length of overlap to correspond to the maximum length of desired adjustment of the waistband length;

one of the overlapping sections of waistband including a flexible member having a first end, a second end and an intermediate portion, said flexible member secured at its first and second ends to the said waistband section at spaced locations with the intermediate portion extending along the outer surface of said waistband section generally within the overlap of said overlapping sections;

friction means comprising a tube encircling said flexible member secured to the second of said pair of overlapping sections of said wasitband and frictionally engaging the intermediate section of said flexible member whereby adjustment in the waistband length is accomplished by movement of said friction means along the intermediate section of said flexible member.

19. A garment adjustment mechanism in accordance with claim 18 wherein said flexible member is a cord.

20. A garment adjustment mechanism in accordance with claim 18 wherein said waistband includes multiple layers of material and said flexible member is secured to said waistband between layers of said wasitband section and wherein one of said layers of said waistband section includes an elongated opening therein and wherein said friction means engages said flexible member through said opening.

21. A garment adjustment mechanism in accordance with claim 20 wherein said flexible member is a cord.

22. A garment adjustment mechanism in accordance with claim 20 wherein said elongated opening in said waistband section comprises a longitudinal slit in a layer of said waistband section.

* * * * *